US007032270B2

(12) United States Patent
Vitantonio et al.

(10) Patent No.: US 7,032,270 B2
(45) Date of Patent: Apr. 25, 2006

(54) TOILET CLEANING APPARATUS AND CADDY

(75) Inventors: Marc. L. Vitantonio, South Russell, OH (US); Renard J. Passerell, Litchfield, OH (US); Robert Soreo, Cleveland Heights, OH (US); Daniel J. Wanhainen, Twinsburg, OH (US); John R. Nottingham, Bratenahl, OH (US); John W. Spirk, Gates Mills, OH (US)

(73) Assignee: Novalabs, LLC, Bratenahl, OH (US)

( * ) Notice: Subject to any disclaimer, the term of this patent is extended or adjusted under 35 U.S.C. 154(b) by 0 days.

(21) Appl. No.: 10/656,314

(22) Filed: Sep. 5, 2003

(65) Prior Publication Data

US 2004/0088808 A1 May 13, 2004

Related U.S. Application Data

(60) Provisional application No. 60/408,410, filed on Sep. 5, 2002, provisional application No. 60/434,862, filed on Dec. 19, 2002.

(51) Int. Cl.
*A47K 11/10* (2006.01)
*A46B 7/04* (2006.01)

(52) U.S. Cl. ..... 15/104.94; 15/210.1; 15/160; 15/172

(58) Field of Classification Search ..... 15/104.94, 15/210.1, 104.93, 146, 160, 171–172, 244.2
See application file for complete search history.

(56) References Cited

U.S. PATENT DOCUMENTS

| | | | |
|---|---|---|---|
| 2,271,861 | A | 3/1942 | Harris |
| 2,402,577 | A | 6/1946 | Rodgers |
| 2,572,178 | A | 10/1951 | Monroe et al. |
| 2,610,347 | A | 9/1952 | Kleiner |
| 2,635,274 | A | 4/1953 | Hatcher et al. |
| 2,648,085 | A | 8/1953 | Rodgers |
| 2,668,974 | A | 2/1954 | Jaeger |
| 2,786,223 | A | 3/1957 | Ziskind |
| 2,816,311 | A | 12/1957 | Beck et al. |
| 2,816,312 | A | 12/1957 | Beck |
| 2,816,313 | A | 12/1957 | Beck et al. |
| 2,996,744 | A | 8/1961 | Rodgers et al. |
| 2,998,614 | A | 9/1961 | Winch |
| 3,101,500 | A | 8/1963 | Paolantonio |
| 3,221,356 | A | 12/1965 | Schirmer |
| 3,225,375 | A | 12/1965 | Atkinson et al. |
| 3,383,158 | A | 5/1968 | Leland |
| 3,546,755 | A | 12/1970 | Lynch |
| 3,563,241 | A | 2/1971 | Evans |
| 3,671,184 | A | 6/1972 | Cuculo |

(Continued)

FOREIGN PATENT DOCUMENTS

| | | |
|---|---|---|
| WO | WO 90/11180 | 10/1990 |

(Continued)

*Primary Examiner*—John Kim
*Assistant Examiner*—Shay L. Balsis
(74) *Attorney, Agent, or Firm*—Calfee, Halter & Griswold

(57) ABSTRACT

A toilet cleaning apparatus and caddy is provided which includes a tool which may be held in a user's hand. A swab, which is flushable down the toilet after the cleaning process is complete, is provided which is easily attached and detached from the tool. The tool is movable to a number of operative positions which assist in the loading, holding, or removal of the swab. A caddy is also provided which can hold the tool as well as unused swabs.

28 Claims, 13 Drawing Sheets

U.S. PATENT DOCUMENTS

| | | | | |
|---|---|---|---|---|
| 3,753,267 | A | 8/1973 | Johnson, Sr. | |
| 3,950,578 | A | 4/1976 | Laumann | |
| 4,031,673 | A | 6/1977 | Hagelberg | |
| 4,035,540 | A | 7/1977 | Gander | |
| 4,309,469 | A | 1/1982 | Varona | |
| 4,343,403 | A | 8/1982 | Daniels et al. | |
| 4,466,152 | A | 8/1984 | Moss et al. | |
| 4,493,124 | A | 1/1985 | Agapiou | |
| 4,642,836 | A | 2/1987 | Bokmiller | |
| 4,852,201 | A | 8/1989 | Wundrock et al. | |
| 5,252,332 | A | 10/1993 | Goldstein | |
| 5,264,269 | A | 11/1993 | Kakiuchi et al. | |
| 5,281,306 | A | 1/1994 | Kakiuchi et al. | |
| 5,500,281 | A | 3/1996 | Srinivasan et al. | |
| 5,509,913 | A | 4/1996 | Yeo | |
| 5,538,783 | A | 7/1996 | Hansen et al. | |
| 5,571,618 | A | 11/1996 | Hansen et al. | |
| 5,592,713 | A | 1/1997 | Rones | |
| 5,609,727 | A | 3/1997 | Hansen et al. | |
| 5,614,570 | A | 3/1997 | Hansen et al. | |
| 5,630,243 | A | 5/1997 | Federico et al. | |
| 5,672,418 | A | 9/1997 | Hansen et al. | |
| 5,693,411 | A | 12/1997 | Hansen et al. | |
| 5,789,326 | A | 8/1998 | Hansen et al. | |
| 5,875,512 | A | 3/1999 | Lathan | |
| 5,905,046 | A | 5/1999 | Takeda et al. | |
| 5,941,379 | A | 8/1999 | Barardo | |
| 5,981,012 | A | 11/1999 | Pomplun et al. | |
| 6,094,771 | A | 8/2000 | Egolf et al. | |
| 6,228,218 | B1 | 5/2001 | Takeuchi et al. | |
| 6,291,372 | B1 | 9/2001 | Mumick et al. | |
| 6,295,688 | B1 | 10/2001 | Sayles et al. | |
| 6,305,044 | B1 * | 10/2001 | James et al. | 15/227 |
| 6,319,863 | B1 | 11/2001 | Takeuchi et al. | |
| 6,429,261 | B1 | 8/2002 | Lang et al. | |
| 6,444,214 | B1 | 9/2002 | Cole et al. | |
| 6,446,792 | B1 | 9/2002 | Kaniaris, Jr. | |
| 6,451,718 | B1 | 9/2002 | Yamada et al. | |
| 6,460,215 | B1 | 10/2002 | Dues et al. | |
| 6,463,620 | B1 | 10/2002 | Busha | |
| 6,548,592 | B1 | 4/2003 | Lang et al. | |
| 6,745,427 | B1 * | 6/2004 | Trenz et al. | 15/104.94 |
| 2001/0023160 | A1 | 9/2001 | Yamada et al. | |
| 2002/0007527 | A1 | 1/2002 | Hart | |
| 2002/0031966 | A1 | 3/2002 | Tomarchio et al. | |
| 2002/0054784 | A1 | 5/2002 | Wolf | |
| 2002/0065011 | A1 | 5/2002 | Takeuchi et al. | |
| 2002/0083542 | A1 | 7/2002 | Hart | |
| 2002/0146552 | A1 | 10/2002 | Mumick et al. | |
| 2002/0155281 | A1 | 10/2002 | Lang et al. | |
| 2002/0176877 | A1 | 11/2002 | Cole et al. | |
| 2004/0093678 | A1 * | 5/2004 | Hart et al. | 15/104.94 |

FOREIGN PATENT DOCUMENTS

| | | |
|---|---|---|
| WO | WO 92/15742 | 9/1992 |
| WO | WO 96/30576 | 10/1996 |
| WO | WO 99/06622 | 2/1999 |
| WO | WO 02/069497 A2 | 8/2002 |
| WO | WO 02/077040 A2 | 10/2002 |
| WO | WO 02/077041 A2 | 10/2002 |
| WO | WO 02/077042 A2 | 10/2002 |
| WO | WO 02/077048 A2 | 10/2002 |
| WO | WO 02/077345 A2 | 10/2002 |
| WO | WO 02/077365 A1 | 10/2002 |
| WO | WO 03/005874 A1 | 1/2003 |
| WO | WO 03/022318 A1 | 3/2003 |

* cited by examiner

TOILET CLEANING APPARATUS AND CADDY

PRIORITY CLAIM

This application claims the benefit of U.S. provisional patent application No. 60/408,410 filed on Sep. 5, 2002 the entirety of which is hereby incorporated by reference and claims the benefit of provisional patent application No. 60/434,862 filed on Dec. 19, 2002, the entirety of which is hereby incorporated by reference.

BACKGROUND OF THE INVENTION

One of the most difficult chores in the bathroom is cleaning the toilet bowl. Traditional methods of bowl cleaning utilize two common objects, first a container of cleaner in either a liquid or granular form and second a scrub brush. The cleaning method involves introducing the cleaner into the bowl water or bowl sides and then manipulating the scrub brush to manually cleanse soiled areas above and below the bowl waterline.

Traditional methods and objects have a number of drawbacks. First, it is often difficult to bring the cleaner into areas above the waterline within the bowl. Some cleaner containers include angled necks allowing cleaner to be directly applied to this surface, but to coat the entire bowl requires more cleaner than would normally be used. Second, a scrub brush is often remains dirty after cleaning the bowl is complete. The brush is swished in semi-clean refill water and removed to dry in a caddy or by simply being stood up in a corner. Finally a user often is sprinkled by dirty water from the bristles of a scrub brush at one time or anther during the cleaning process.

An efficient cleaning method using superior tools is desired. At the conclusion of the cleaning process any tools which must be stored within the bathroom should be clean. Additionally, there should be an easy way to get the cleaner into the areas above the bowl water line.

SUMMARY OF THE PRESENT INVENTION

The present apparatus and method overcomes the shortcomings in the prior art. The present apparatus includes a one time use swab which may be flushed into the toilet drain after the cleaning process is complete. The swab may include a pre-applied detergent thus making it easy to get the detergent into areas above the bowl waterline. The tool which holds the swab provides a way to remove the swab without the users hand contacting the swab. A caddy which supports the tool also provides means for loading a swab onto the tool without a user touching the head of the tool.

In one embodiment the apparatus includes a tool having a handle section and a head having two or more separable portions wherein the portions of the head may be manipulated into multiple configurations by a user of the tool wherein one of the configurations assists in holding a swab upon the head of the tool under a spring bias.

In another embodiment the apparatus includes a tool having a head and a handle section, a flushable swab having a pocket-like configuration and fitting over the head of the tool for attachment thereto wherein the tool has a loading position wherein the swab is placed upon the tool, an operating position wherein the tool assists in holding the swab upon the tool, and a removing position, wherein the tool assists in displacing the swab from the tool. These and other features, aspects and advantages of the present invention will be fully described by the following description, appended claims, and accompanying drawings.

DETAILED DESCRIPTION OF THE PREFERRED AND ALTERNATE EMBODIMENTS

Figures 3A, 3B:
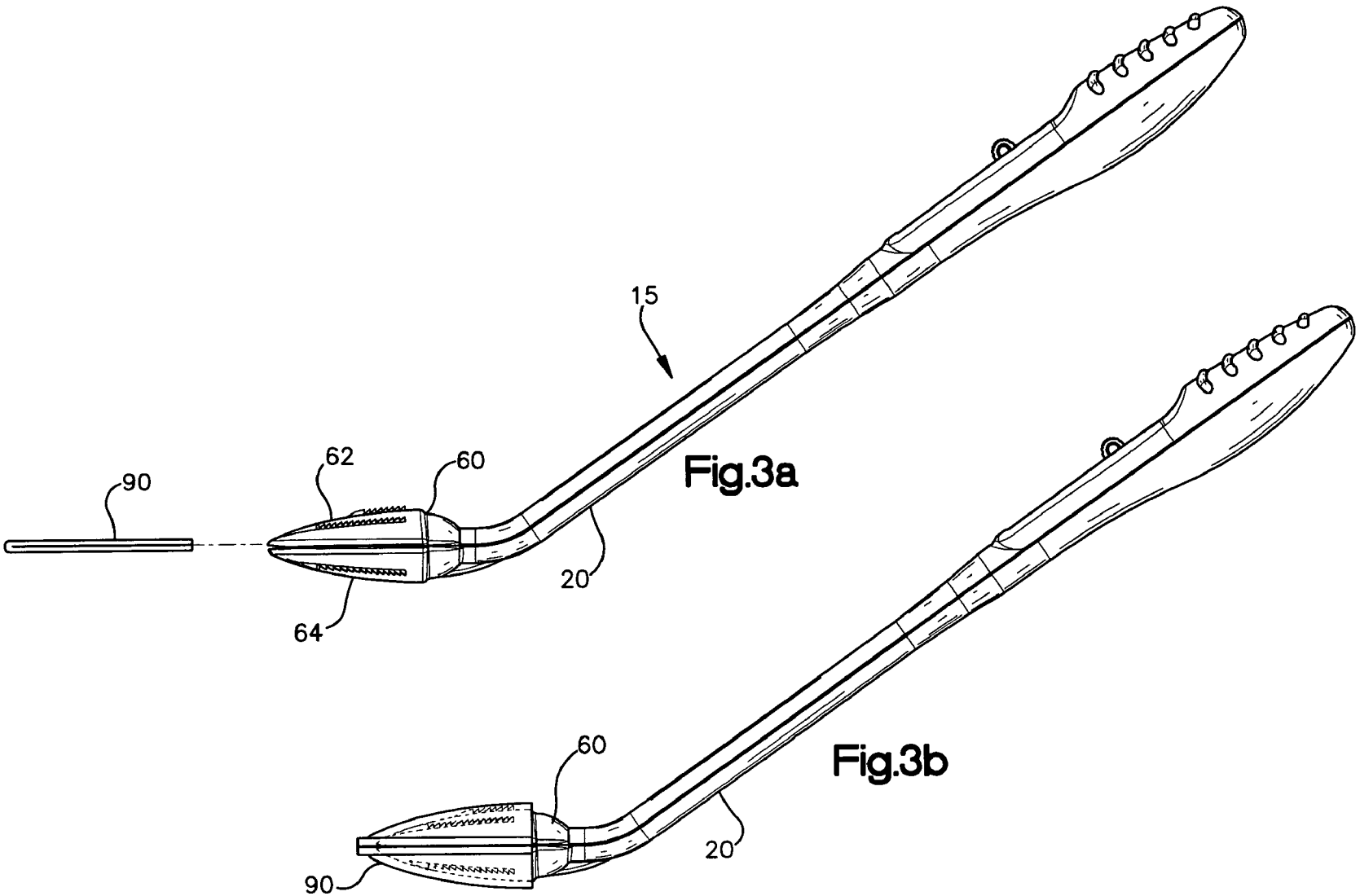
FIG. 3*a* is a side view of the toilet cleaning tool and a swab.
FIG. 3*b* is a side view of the toilet cleaning tool with the swab fitted to the tool.
Figure 7:
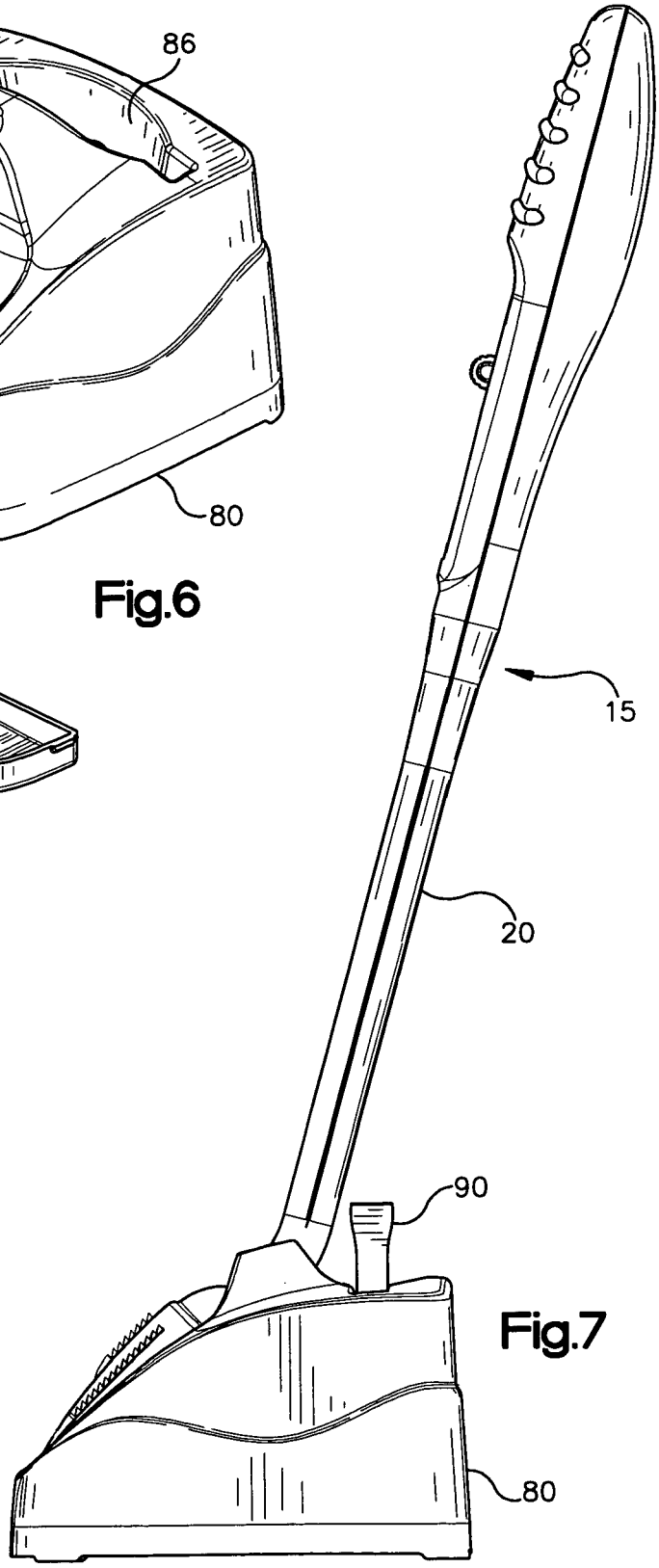
FIG. 7 is a side view of the toilet cleaning tool and a swab supported by the caddy.

As described in more detail below and shown in FIG. 3*a*, a toilet cleaning apparatus 15 is provided which includes a tool 20 and a disposable swab 90. The apparatus 15 may be stored upon a caddy 80 as shown in FIG. 7.

Referring to FIGS. 1*a–c* and 2, the tool 20 includes a handle section 30, a middle section 40 and a head 60. Within the tool 20 a pushrod assembly 50 including actuation components is held. The pushrod assembly 50 is actuated to shift the head 60 into one of three distinct configurations (Neutral, Use, Eject) shown in FIGS. 3*a*, 4 and 5. Each configuration of the pushrod assembly 50 and head 60 serves a particular purpose in the manipulation of the disposable swab 90.

Referring back to FIGS. 1*a–c* and 2 the handle section 30 is at one end of the tool 20 and includes a portion for gripping 32, which may be ribbed, and a slot portion 34 for accessing a slide control button 52 which extends out from the pushrod assembly 50 within the tool 20. The slot portion 34 of the handle section 30 includes a notch 35 into which the slide control button 52 may be rotated to lock the pushrod assembly 50 in the Use configuration or position. The portion for gripping 32 may be a series of rubber grips added by an overmolding process. Handle slots 31 may be left within the handle section 30 when it is molded and a second molding process adds the portion for gripping 32. The handle section 30 may be hollow and may have a generally tubular shape which is easily grasped by the human hand.

The middle section 40 is adjacent to the handle section 30 and extends in a generally straight direction until bending close to the position where the middle section 40 joins the head 60. The middle section 40 may also be hollow. The head 60 is located adjacent to the middle section 40 opposite of the handle section 30. The head 60 is also preferably hollow. The head 60 may be made of two portions 62 and 64. These portions 62 and 64 may be generally symmetrical shaped halves. The head 60 is shaped in the same general shape as the swab 90 which fits over the head 60. The head 60 may include protrusions, teeth or texturing 70 to assist in holding the swab 90 in place during use. The head 60 may also include one or more holes 61 at the end opposite of the middle section 40 to drain any fluid which may accumulate within the head 60, middle section 40 or handle section 30. At this end of the head 60 the head portions 62 and 64 may also include relieved portions of reduced thickness which provide a small gap between the portions 62 and 64. The gap allows the two head portions 62 and 64 to be opened as described in more detail below without interfering with each other. An additional drain hole 43 is provided within the middle section 40.

In a preferred embodiment, the handle section 30, middle section 40 and head 60 of tool 20 are manufactured from common material which can be any polymer, including: polycarbonate, cycolac or Acrylonitrile Butadiene Styrene (ABS). In one embodiment of the invention one portion of the handle section 30, middle section 40 and head 60 are molded as a single piece. Additionally, the remaining portion of the handle section 30 and middle section 40 are molded in a second piece. This allows the pushrod assembly 50 to be easily placed within the middle section 40 and handle section 30 and sealed in place by attachment of the remaining piece of the handle section 30 and middle section 40. The pieces may be attached by sonic welding techniques or solvent bonding. A number of tabs and slots or other alignment guides may be molded into the tool pieces to facilitate the alignment and joining process. Alignment ribs 41 are molded into the middle section 40 and handle section 30 to provide a guide for the pushrod assembly 50. The alignment ribs 41 may be placed at similar positions upon the matching molded pieces of the middle section 40 or may be offset for the purpose of allowing drainage of any accumulated water within the tool 20. The alignment ribs 41 may also be used for holding the springs 54 or other components of the pushrod assembly 50 in a desired position and as stopping points for motion of the slider washer 55. The second portion 62 of the head 60 may be molded as a solitary piece.

The pushrod assembly 50 fits within the tool 20 and includes a long narrow pushrod 56, the slide control button 52 used to actuate the pushrod 56, springs 53 and 54, a slider washer 55 as well as other washers and clips on either side of the button 52 to assist in moving the button 52 to and from desired positions. The slide control button 52 may be rotated within the handle section 30, however the rotation is constrained by the openings of the slot portion 34. At the end of the pushrod assembly 50 opposite the control button 52 a cam 58 is used to interact with the head 60 of the tool 20. The cam 58 may interact with the head 60 via a cam follower plate 66 used to assist in translating movement of the pushrod 56 to the head 60. The cam follower plate 66 is flat and may be attached to one half of the head 60. The cam follower plate may also include slots on its sides which in combination with pivot pins 68 on the head portion 64 act as a guide mechanism.

The slider washer 55 is affixed to the pushrod 50, but can interfere with the alignment ribs 41 upon the middle section, thus predetermined positions of the pushrod assembly 50 may be reached at these points of interference as described in more detail below.

Another spring 59 is located within the head 60 and affixed at one end to the cam 58 and at another end to the one portion 62 of the head 60 or the cam follower plate 66. Spring 59 makes sure that the head portion 62 does not get disengaged from the pushrod assembly 50. Spring 59 also expands when the head is in the Use position and helps prevent any binding when the tool 20 is moved from the Use to Neutral positions.

The lower portion of the head 62 may include two pivot pins 68. The pivot pins 68 interact with slots on the side of the cam follower plate 66. The pivot pins 68 allow the upper position 62 to be pivoted into the Use position. Additionally the pivot pins 68 guide the movement of the upper position of the head 62 to be extended into the Eject position.

Referring to FIGS. 2–5, the pushrod assembly 50 housed within the tool 20 may be moved amongst three configurations or positions in order to allow different functions to be performed. Movement of the pushrod 56 is accomplished by moving the slide control button 52, typically by a user's thumb as the user grips the handle section 30 of the tool 20 as well as through the action of springs 53 and 54 and slider washer 55. A first position shown in FIG. 3*a*, the Neutral or loading position, is recognized by the position of the two portions 62 and 64 of the head. The two portions 62 and 64 are aligned and all edges of each portion 62 are in close proximity to each of the corresponding edges of the opposite portion 64. This Neutral position is used for application or loading of the swab 90 around the head 60 of the tool 20 as shown in FIG. 3*b*. No user contribution is necessary to place the head and pushrod assembly into the Neutral position. When the pushrod assembly 50 is in the Neutral position, the springs 53 and 54 shown in FIG. 2 within the handle section 30 are in a generally uncompressed/unextended state.

Figure 4:
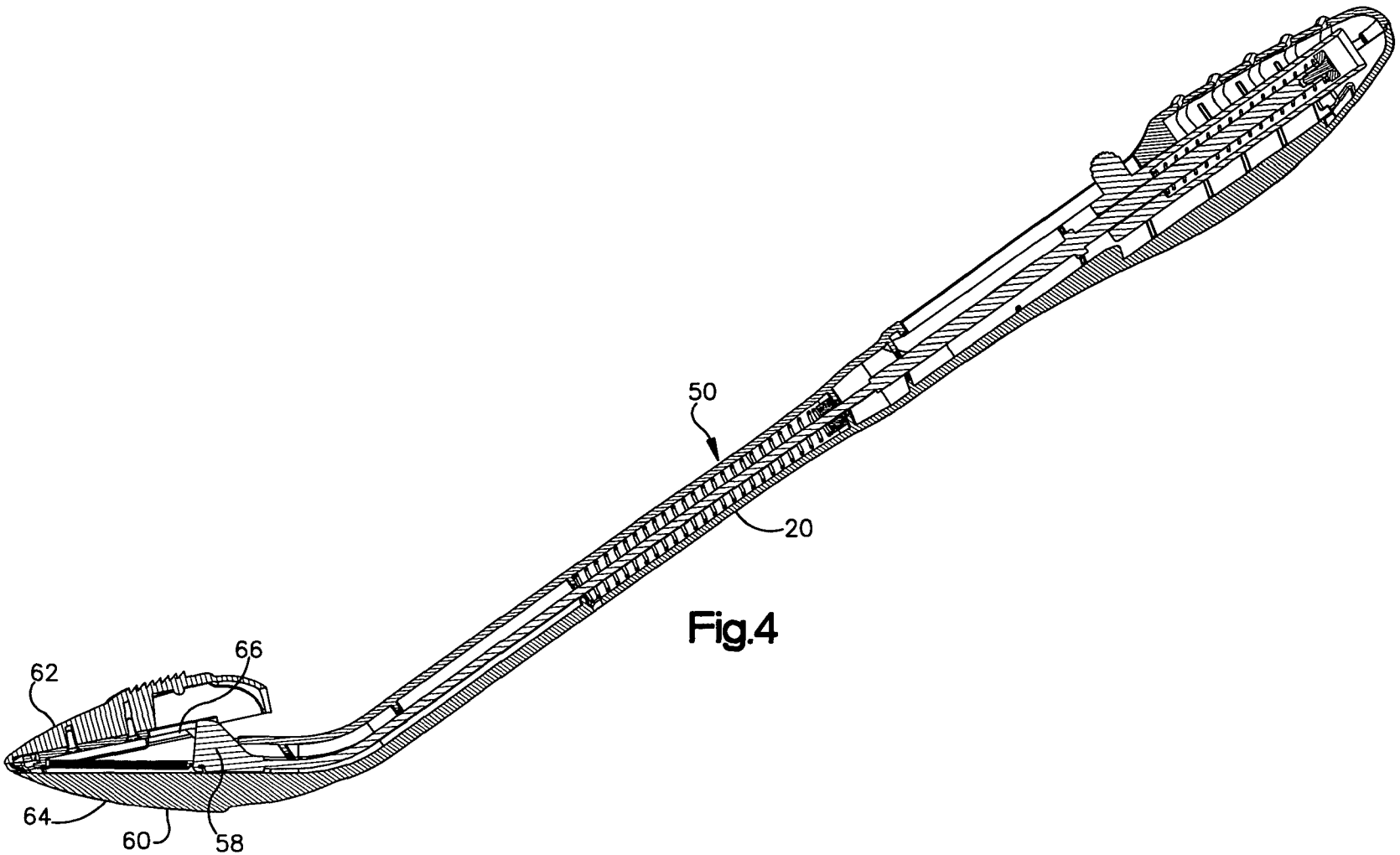
FIG. 4 is a cut away view of the preferred embodiment of the toilet cleaning tool in a first operative configuration.

The pushrod assembly 50 may be moved to a Use or operating position as shown in FIG. 4 in which the two portions 62 and 64 of the head 60 remain aligned, but only the edges opposite the middle section 40 are in close proximity (resembling an open clam shell). The relieved portions of the head portions 62 and 64 prevent any interference when the pushrod assembly is in this position. In this Use position tension is applied to the overlying swab 90 (not shown) to prevent it from falling off of the head 60.

Figure 1A:
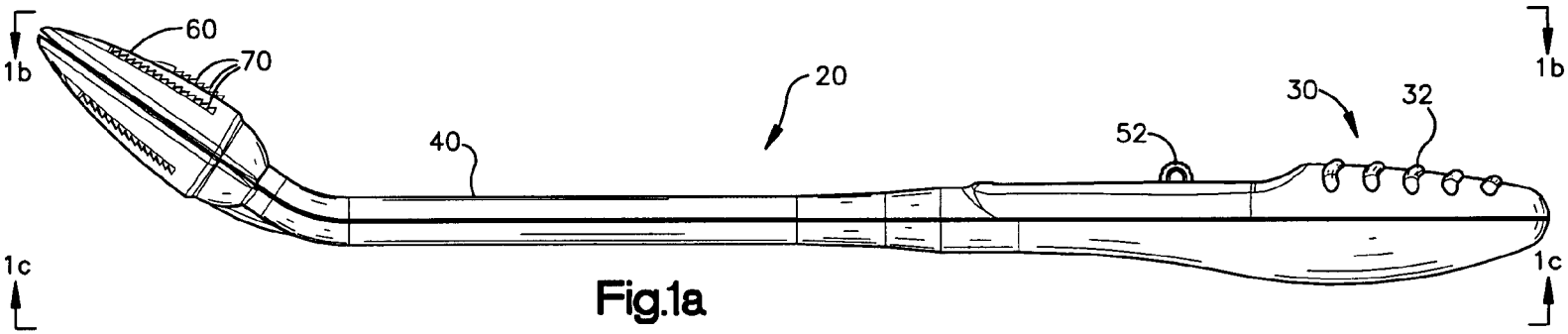
FIG. 1*a* is a side view of a preferred embodiment of a toilet cleaning tool.
Figure 1B:
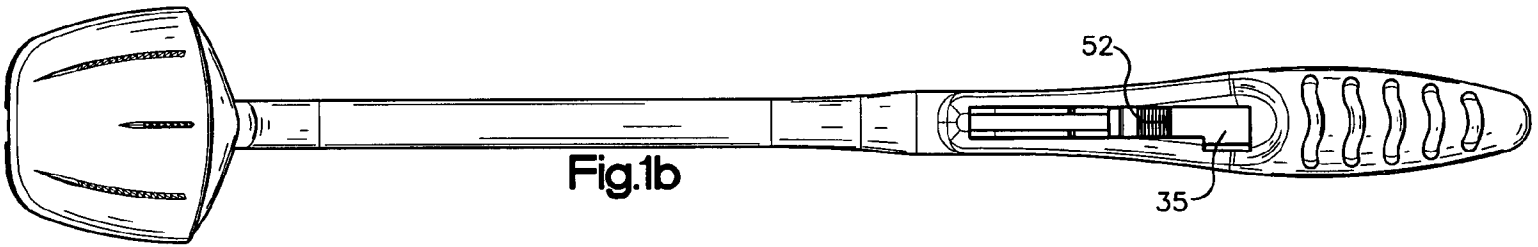
FIG. 1*b* is a top view of the preferred embodiment of the toilet cleaning tool.
Figure 1C:
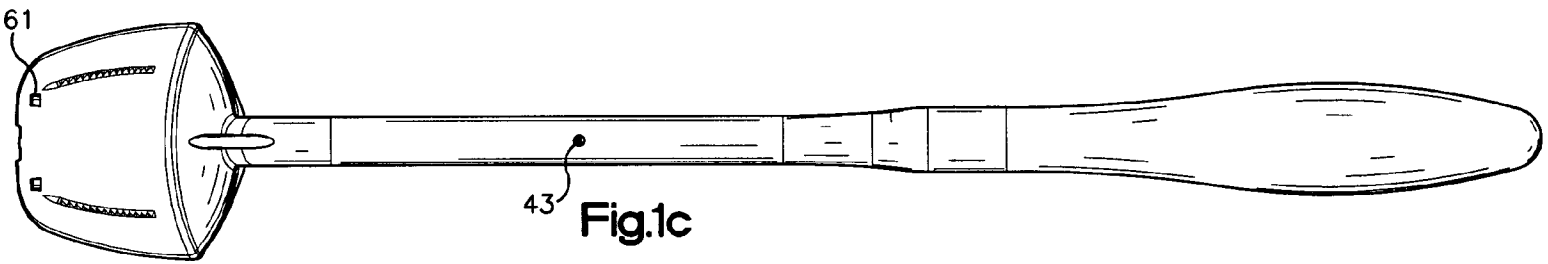
FIG. 1*c* is a bottom view of the preferred embodiment of the toilet cleaning tool.
Figure 2:
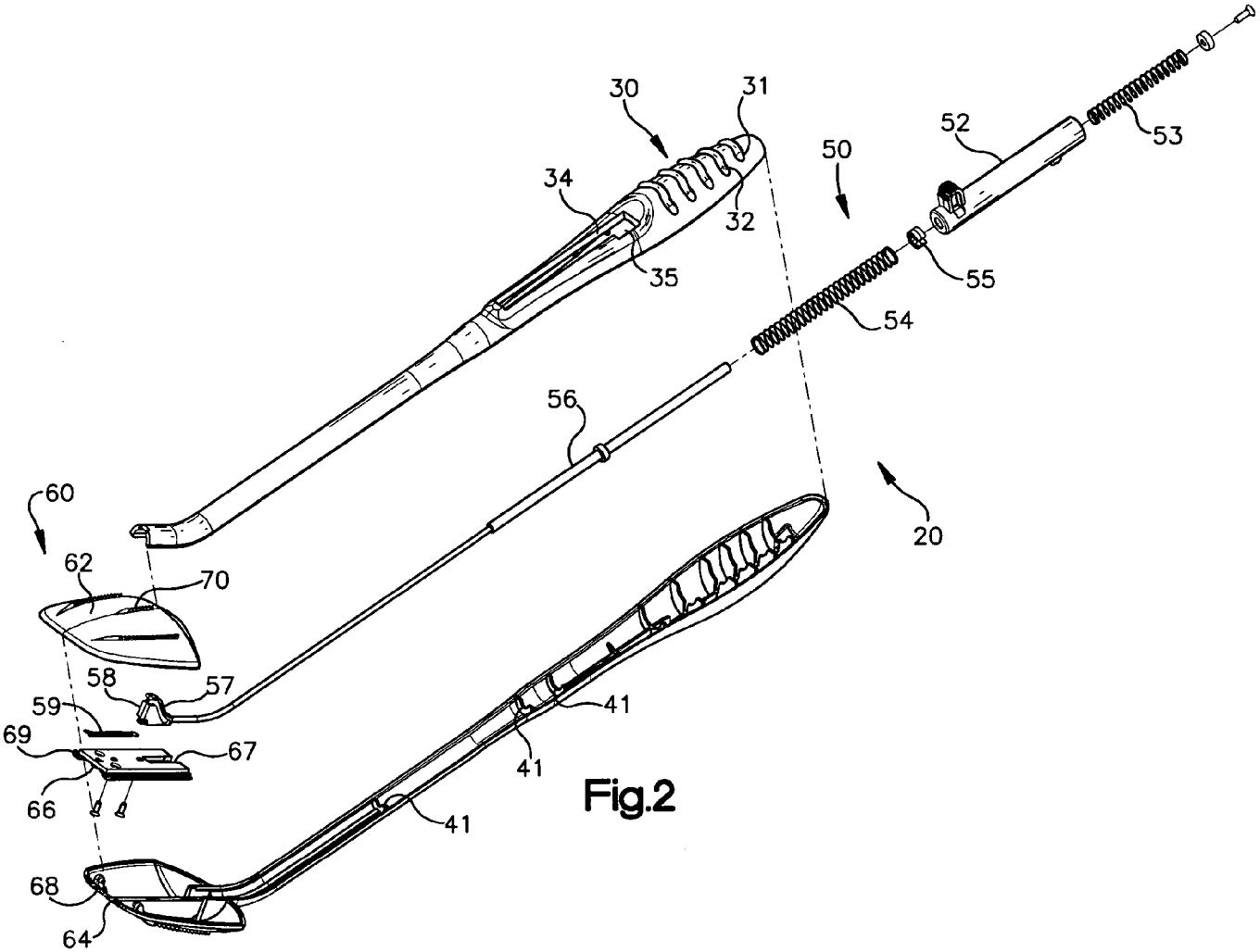
FIG. 2 is an exploded view of the preferred embodiment of the toilet cleaning tool.

Separation of the two portions 62 and 64 of the head is accomplished by the interaction of the pushrod assembly's cam 58 with the cam follower plate 66 which is affixed to one portion 62 of the head 60. Referring to FIG. 2, the cam 58 includes a groove 57 on one or both of its side faces. The cam follower plate 66 includes one or more pins 67 which fit into the grooves 57 on the cam 58. As the pushrod 56 and cam 58 are retracted into the middle section 40 of the tool 20, the pins 67 within the cam follower plate 66 follow the grooves 57 within the cam 58 and as a result push one portion 62 of the head 60 upwards. In moving to the Use position, spring 53 of the pushrod assembly 50 is slightly compressed until slider washer 55 reaches a stop point and then spring 53 is noticeably compressed. The pushrod assembly 50 may be locked in the Use position by rotating the slide control button 52 into the notch 35 of the slot portion 34. Spring 54 remains in a generally uncompressed/unexpanded state in the Use position. However if the head portions 62 and 64 are compressed together during use in a locked Use position, this results in compression of spring 54 which in turn tries to reexpand. As a result a tensioning function is provided even though the button 52 is in a locked position. This tensioning function is helpful because it allows the head portions 62 and 64 to rebound if compressed by force applied during bowl scrubbing. Also if the swab 90 swells slightly during use, the tensioning function will allow the head portions 62 and 64 to open further and keep force upon the swab 90, thus keeping it upon the tool 20.

Figure 5:
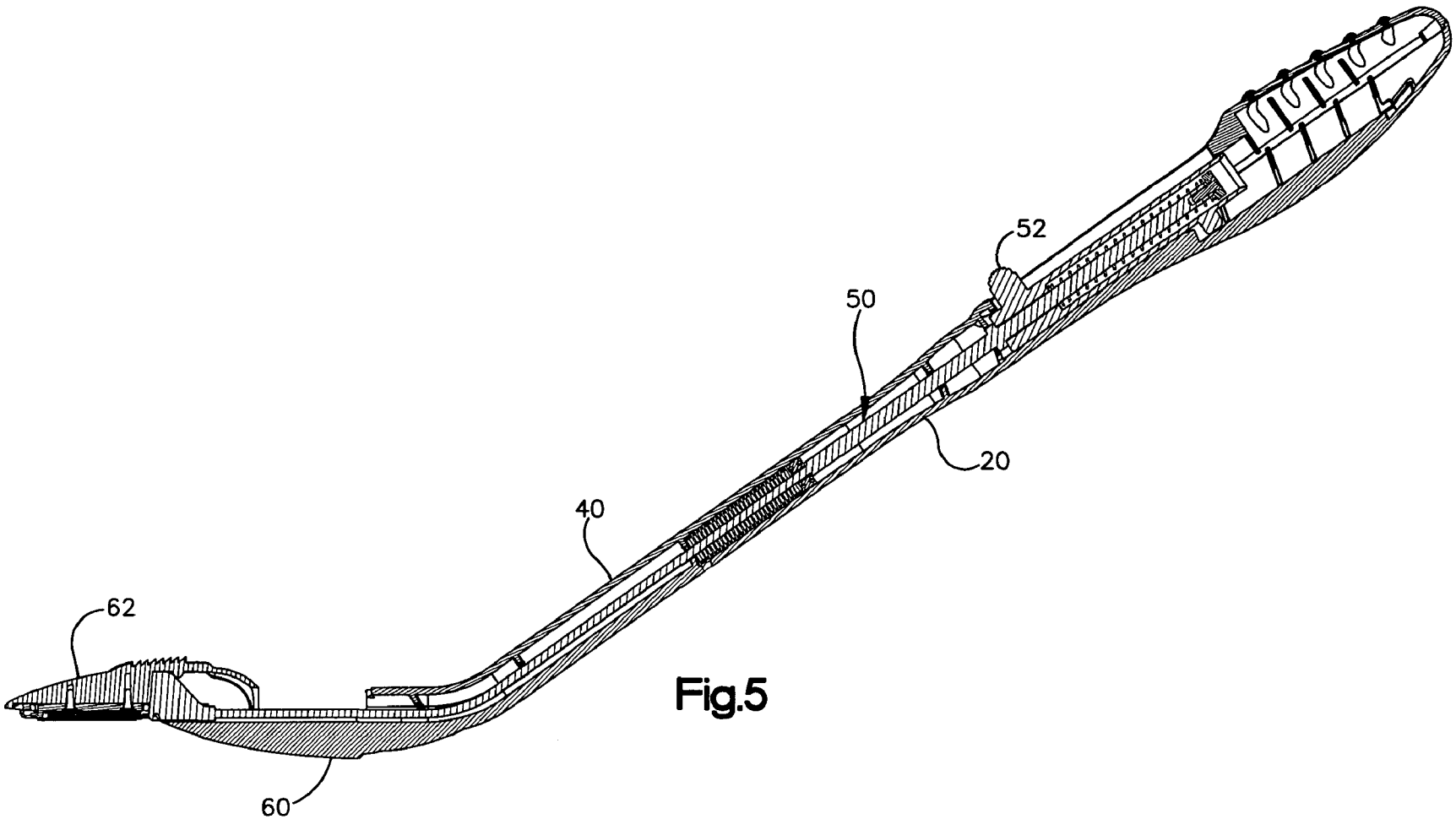
FIG. 5 is a cut away view of the preferred embodiment of the toilet cleaning tool in another operative configuration.

Referring to FIG. 5, the pushrod assembly 50 and head 60 may also be moved to an Eject or removing position. In the Eject position, one portion 62 of the head 60 is pushed forward and out of alignment from the second portion 64. In this position, the swab 90 (not shown) is also pushed forward and may easily be removed from the head 60. To reach the Eject position from the Neutral position, the pushrod 56 is extended further out of the middle section 40 of the tool 20 by the slide control button 52. The cam 58 includes a face which contacts a surface upon the cam follower plate 66 of the head 60. The movement of the cam follower plate 66 then moves one half 62 of the head 60. In the Eject position one spring 54 of the pushrod assembly 50 is compressed while spring 53 remains in a generally uncompressed/unexpanded state.

Referring to FIGS. 3*a*, 3*b* and 9*a–f*, the swab 90 has a shape generally similar to that of the head 60. In a preferred embodiment, the swab 90 has a pocket-like configuration wherein a majority of the head 60 is covered by the swab 90, and the open end of the pocket allows the two portions 62 and 64 of the head 60 to be manipulated in the manners previously described. In a preferred embodiment of the invention the swab 90 when placed over the head 60 extends to the point of greatest width of the head 60. The swab 90 can be made of any non-paper material, but is preferably a blend of cotton and rayon. A reasonably biodegradable natural or synthetic fiber which is easily bonded and capable of being processed into a non-woven fabric may be substituted for rayon. The blend may contain anywhere from 0 to 100 percent cotton by weight. A preferred blend range is from about 75 percent cotton and about 25 percent rayon to about 85 percent cotton and about 15 percent rayon by weight. A preferred blend within the range is about 80 percent cotton and about 20 percent rayon. In a preferred embodiment the blend is non-woven and needle punched. As a substitute for needle punching, the blend may be hydro entangled. The rayon may have a denier of 8.

The swab material, without a coating of detergent, coloring and binder may have a weight in a range from about 183.2 to about 224.0 grams/square meter (about 5.34 to about 6.60 ounces per square yard). In a preferred embodiment of the swab the swab material may have a weight of about 203.6 grams/square meter (about six ounces per square yard).

Figure 9A:
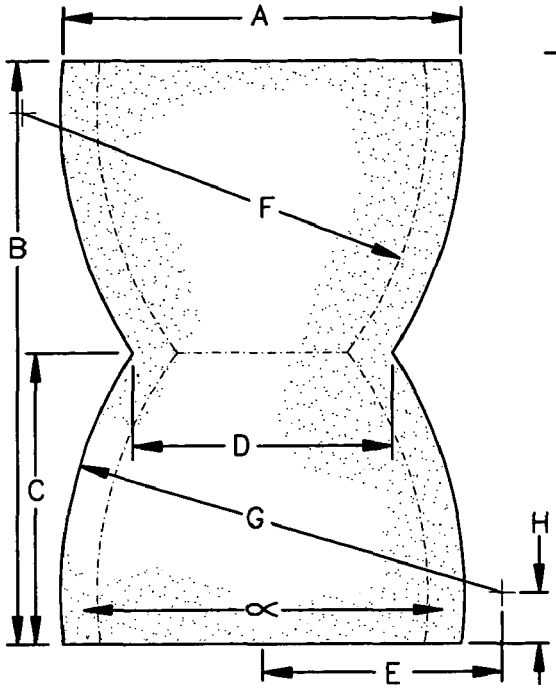
FIG. 9*a* is top view of a one piece swab prior to full assembly.
Figure 9B:
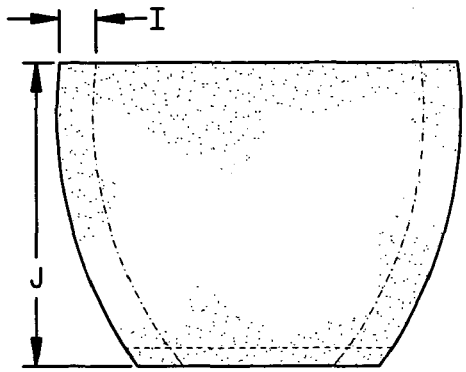
FIG. 9*b* is a top view of an assembled one piece swab.
Figure 9C:
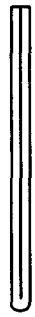
FIG. 9*c* is a side view of an assembled one piece swab.
Figure 9D:
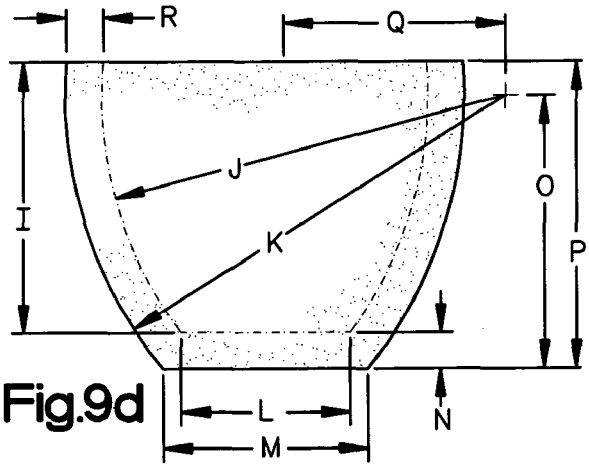
FIG. 9*d* is a top view of an assembled two piece swab.
Figure 9E:
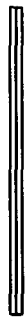
FIG. 9*e* is a side view of an assembled two piece swab.

As shown in FIGS. 9*d–e*, the swab 90 may be formed from two separate pieces which are then attached together on or adjacent to up to three sides by methods such as sewing, melting, fabric welding, or gluing. Alternatively as shown in FIGS. 9*a–c* the swab may begin as a single piece which is folded and then attached together on or adjacent to two sides using the same techniques. In both situations a pocket-like swab 90 is formed with one open side which allows entrance of the tool's head 60.

Referring to FIGS. 9*a–f*, the swab 90 has an interior pocket shape defined by the attached edges of the pad and folded common edge in a one-piece pad design. Preferably the interior shape is substantially similar to the shape of the head 60 of the tool. The swab 90 also includes an outer shape which preferably is the same as the interior pocket shape, but may actually be any other desired shape. The interior pocket shape matches the shape defined by both portions of the head 60 which allows the swab 90 to held in place by the head 60 after simple insertion of the head 60 into the swab 90. The swab 90 is secured in this position by movement of the portions 62 and 64 of the head into a Use position. The preferred shape of the head 60 and interior pocket shape is a trapezoidal shape with the two non-parallel sides bowed outwardly.

Chart 1 below in association with FIGS. 9*a–e* shows the preferred exterior dimensions of swabs 90 formed from either one piece of two pieces.

CHART 1

| Reference | Dimension (centimeters) ± 0.01 | Dimension (inches) ± 0.01 |
|---|---|---|
| A | 9.68 | 3.81 |
| B | 14.30 | 5.63 |
| C | 7.14 | 2.81 |
| D | 6.30 | 2.48 |
| E | 5.82 | 2.29 |
| F | 9.85 | 3.88 |
| G | 10.74 | 4.23 |
| H | 1.24 | 0.49 |
| I | 6.68 | 2.63 |
| J | 9.85 | 3.88 |
| K | 10.74 | 4.23 |
| L | 4.11 | 1.62 |
| M | 5.00 | 1.97 |
| N | 0.89 | 0.35 |
| O | 6.73 | 2.65 |
| P | 7.57 | 2.98 |
| Q | 5.87 | 2.31 |
| R | 0.89 | 0.35 |

Figure 9F:
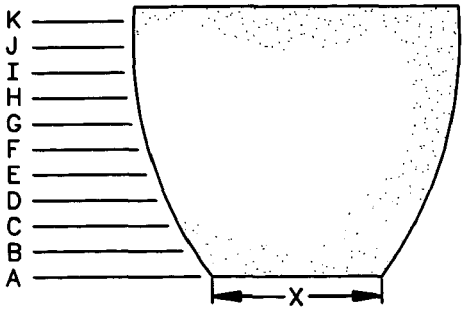
FIG. 9*f* is a dimensional representation of a one or two piece swab.

Chart 2 below in association with FIG. 9*f* shows the preferred interior dimensions of swabs 90 formed from either one piece of two pieces.

CHART 2

| Reference | Reference length (centimeters) ± .250 | Reference length (inches) ± .250 | Width X at Reference length (centimeters) ± .250 | Width X at Reference length (inches) ± .250 |
|---|---|---|---|---|
| A | 0 | 0 | 4.117 | 1.621 |
| B | 0.635 | .250 | 4.978 | 1.960 |
| C | 1.270 | .500 | 5.702 | 2.245 |

CHART 2-continued

| Reference | Reference length (centimeters) ± .250 | Reference length (inches) ± .250 | Width X at Reference length (centimeters) ± .250 | Width X at Reference length (inches) ± .250 |
|---|---|---|---|---|
| D | 1.905 | .750 | 6.309 | 2.484 |
| E | 2.540 | 1.000 | 6.812 | 2.682 |
| F | 3.175 | 1.250 | 7.214 | 2.840 |
| G | 3.810 | 1.500 | 7.526 | 2.963 |
| H | 4.445 | 1.750 | 7.750 | 3.051 |
| I | 5.080 | 2.000 | 7.887 | 3.105 |
| J | 5.715 | 2.250 | 7.943 | 3.127 |
| K | 6.350 | 2.500 | 7.917 | 3.117 |

In a preferred embodiment of the swab, the thickness of a single wall of the swab 90 may be about 3.2 millimeters (about ⅛ inch). The tensile strength at about ten percent elongation of a single wall of the swab 90 in a first direction (shown as α in FIG. 9*a*) may be in the range of about 6.9 to about 19.4 Newtons/centimeter (about 3.9 to about 11.0 pounds/inch). In a second direction, transverse to the first direction, the tensile strength of a single wall of the swab at about ten percent elongation may be in the range of about 0.70 to about 4.1 Newtons/centimeter (about 0.4 to about 2.3 pounds/inch).

Prior to or after the formation and machining of the swab 90, additives are introduced to the swab fabric. These additives may include, binders, surfactants, dyes, scent compounds, disinfectants, and/or detergents. The additive combined may have a weight of about 48.35 to about 53.44 grams/sq. meter (about 1.425 to about 1.575 ounces per square yard). Binders which may be used alone or in combination are Polyvinyl Acetate and Polyvinyl Alcohol. The binder may be applied initially on both sides of the cotton/Rayon swab. Additional binder may be added as the remaining additives are applied to the swab. In a preferred embodiment the detergent used is an anionic detergent based on sodium salt of dodecyl benzene sulfonic acid. A preferred detergent is manufactured by Eastern Color & Chemical Co. and has the title #S-175 Anionic Detergent. The surfactant being used may be one or more of the following: alpha olefin sulfonate, ammonium laureth sulfate, sodium lauryl sulfate; triethanlomine lauryl sulfate.

The swab is easily flushable in part due to its size. However, the swab, in a preferred embodiment, is not of the type which is ripped or torn when removed from the tool head. In fact, the swab is of a sufficient strength, in the preferred embodiment, to resist tearing along the swab seams, since the swab is maintained on the tool head during operation, in the tool Use or operating position under spring tension. The swab is initially inserted onto the tool head. The tool handle section and head portions are then moved to the Use position by the user, such that the portions of the head are spring biased apart. The separation of the tool head portions caused by the spring and cam causes the swab to be placed in tension. If the swab were substantially of paper or other thin materials, it would not resist the tension applied by the tool head, particularly once it was immersed in water and used for toilet scrubbing. Additionally the swab components are preferably biodegradable.

Figure 6:
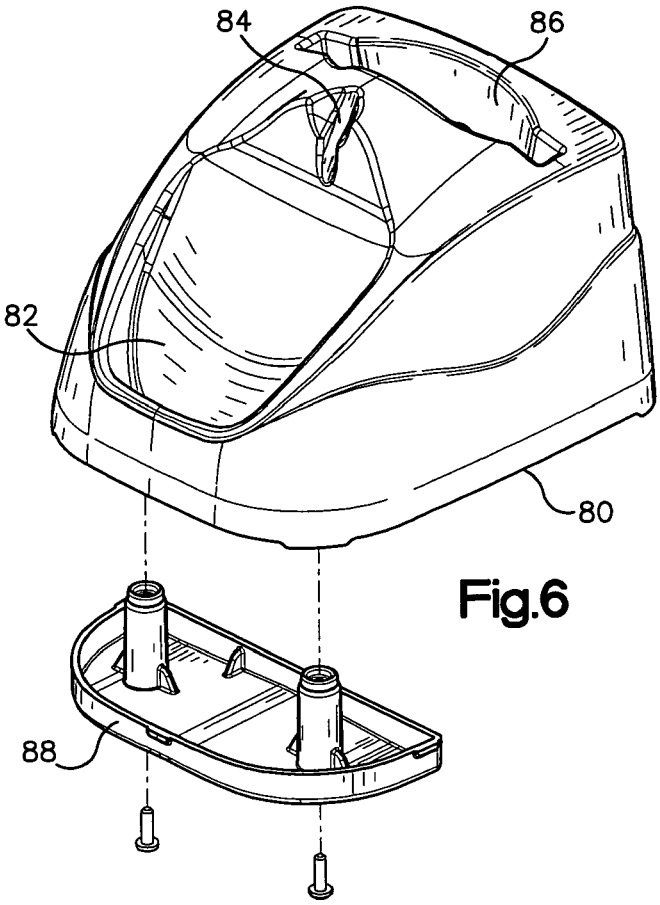
FIG. 6 is an exploded view of a caddy.
Figure 10A:
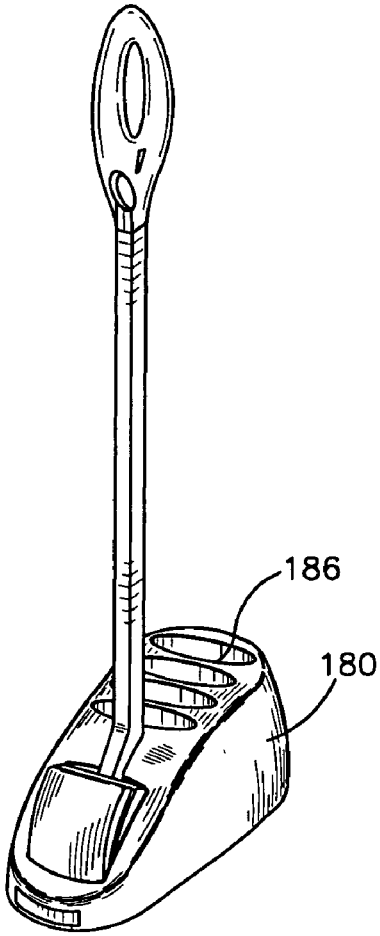
FIG. 10*a* is a perspective view of an alternate embodiment of a toilet cleaning tool and an alternate embodiment of a caddy.
Figure 10B:
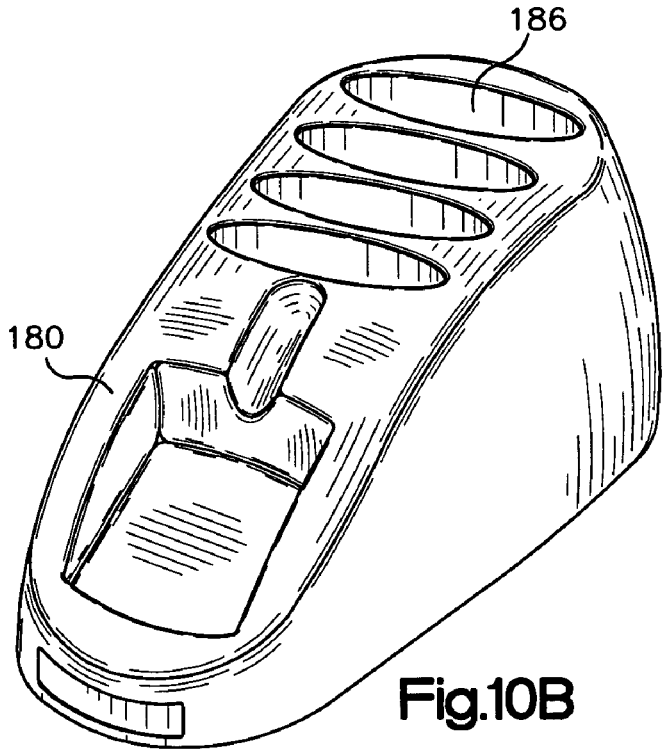
FIG. 10*b* is a perspective view of the alternate embodiment of the caddy alone.

Referring to FIGS. 6 and 7, a caddy 80 may be used to support the tool 20 when a swab is not attached. The caddy 80 may include an indentation 82 similarly shaped to the head 60 of the tool 20 and an indentation 84 shaped like a portion of the middle section 40. Into these indentations 82 and 84 fits the head 60 and middle section 40 of the tool 20 and the tool 20 is held in place. The caddy 80 may also include an additional cavity 86 for placing a replacement swab 90 to assist in "hands-off" application of the swab 90 to the tool 20. Additionally, swabs may be sold positioned within the cavity 86 when sold with the caddy 80. The head 60 of the tool 20 may be inserted into the swab 90, which is supported by the caddy 80 as shown in FIG. 7, without the user having to touch the swab 90 with his hand. The caddy 80 may be made of any material, but preferably is a polymer such as polycarbonate, cycolac or ABS and is formed by molding. The caddy 80 may also include a drip tray 88 below the indentation where the tool 20 is held. FIGS. 10*a* and 10*b* show an alternate embodiment of the caddy 180. Caddy 180 includes a plurality of additional cavities 186 for holding replacement swabs.

Figure 8:
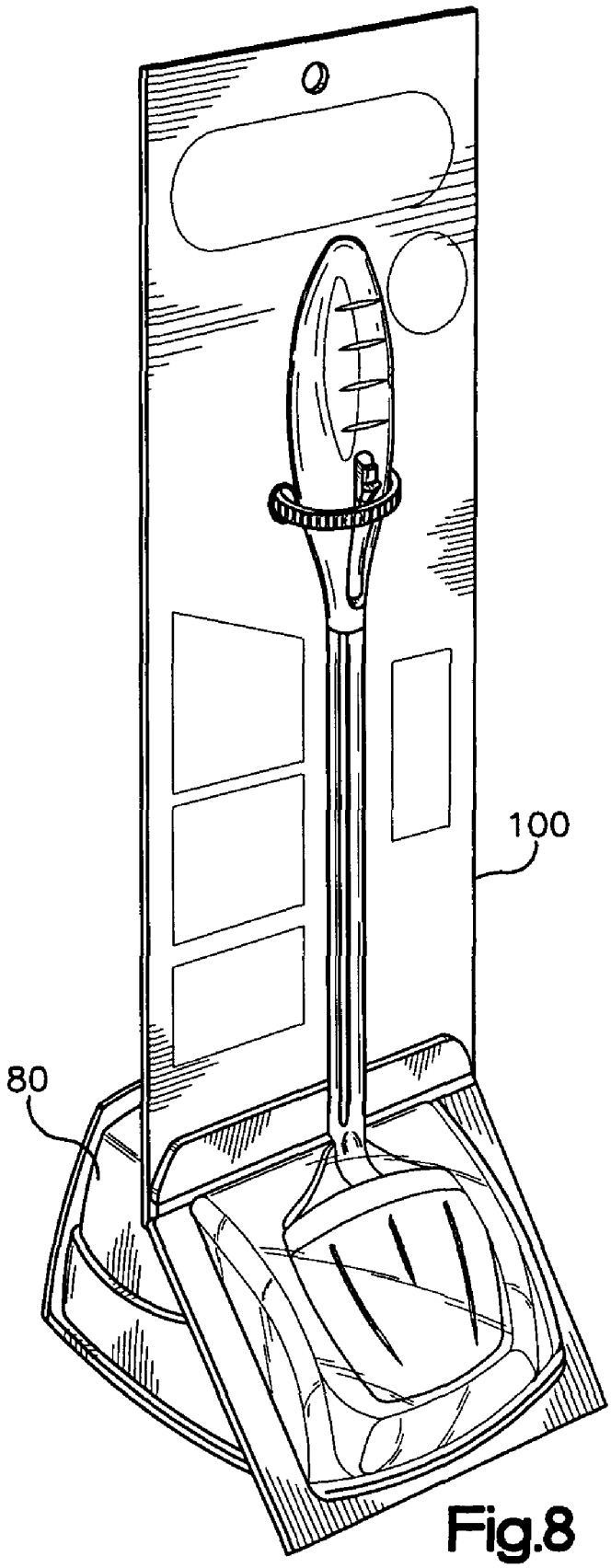
FIG. 8 is a perspective view of the toilet cleaning tool and caddy affixed to a display device for use in sale.

Referring to FIG. 8, the tool 20 and caddy 80 may be held together in multiple ways for shipping and/or display. In one embodiment, the tool 20 and caddy 80 are attached to a cardboard or plastic piece 100 which facilitates the hanging of the tool and caddy upon a display shelf. Additional packages of swabs may also be purchased in separate containers for use within the tool and/or caddy.

Figure 11:
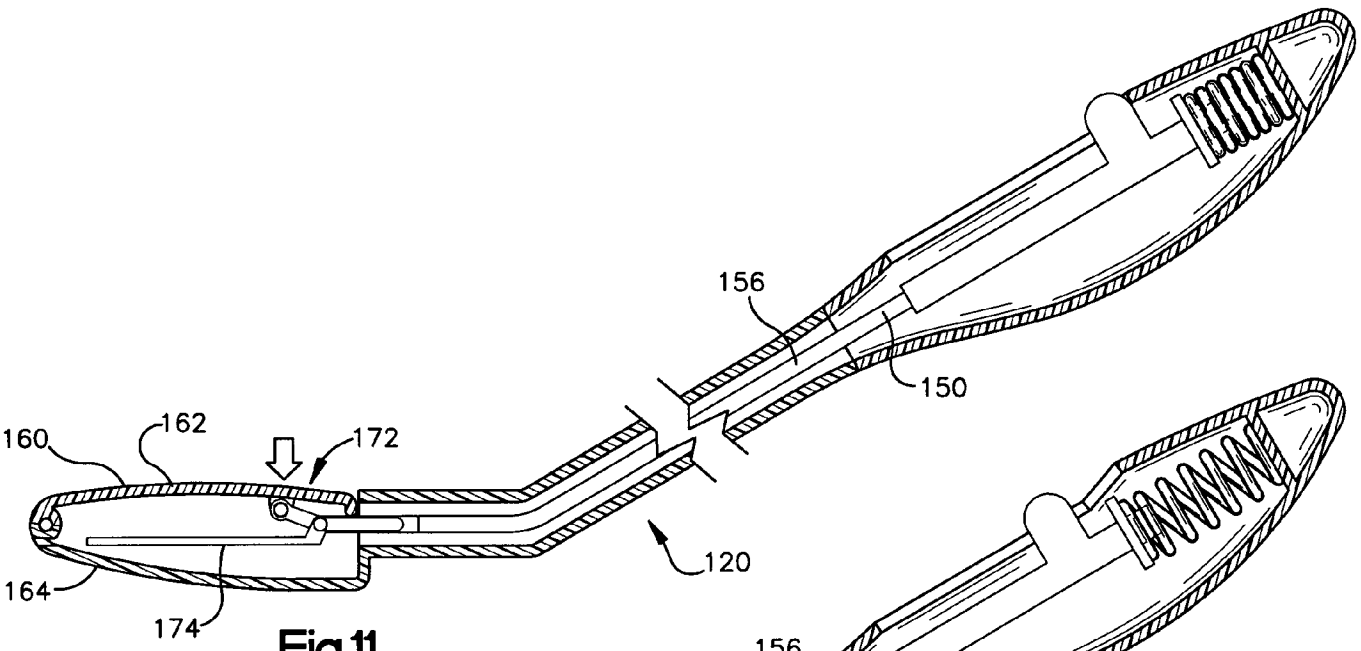
FIG. 11 is a cutaway view of an alternate embodiment of a toilet cleaning tool in a first operative position.
Figure 12:
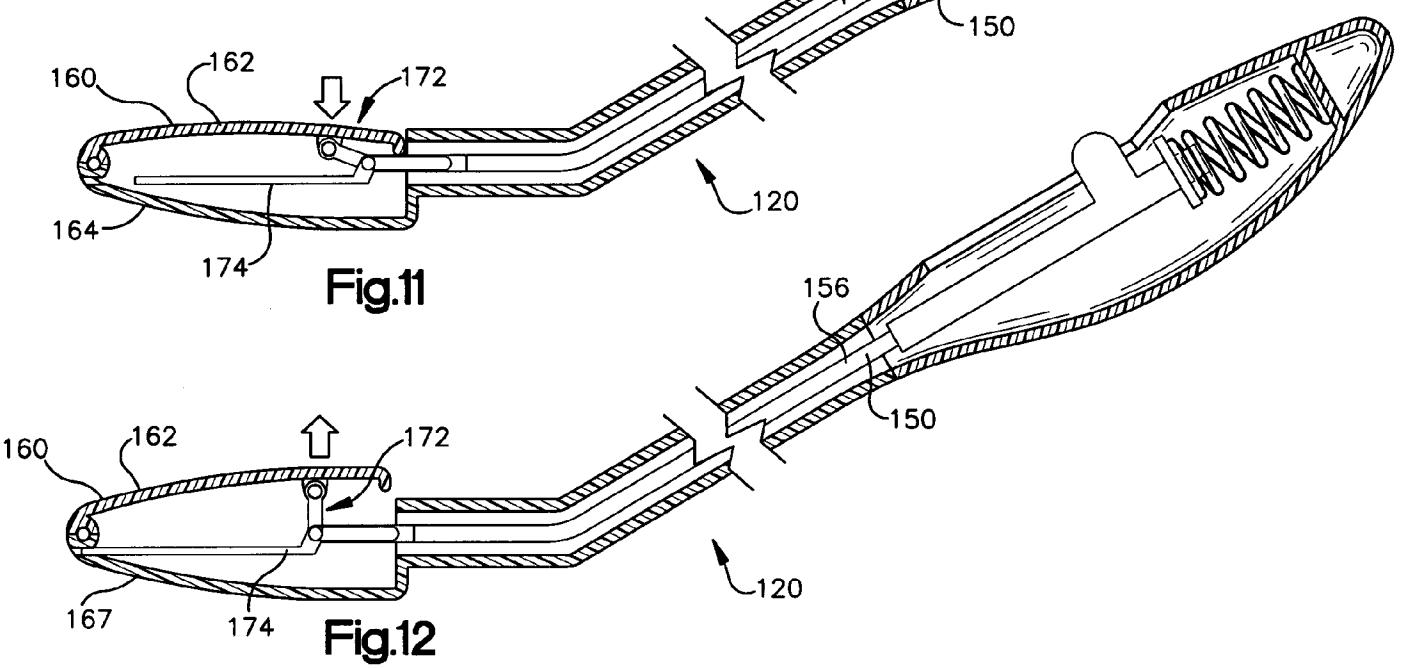
FIG. 12 is a cutaway view of the alternate embodiment of a toilet cleaning tool in a second operative position.
Figure 13:
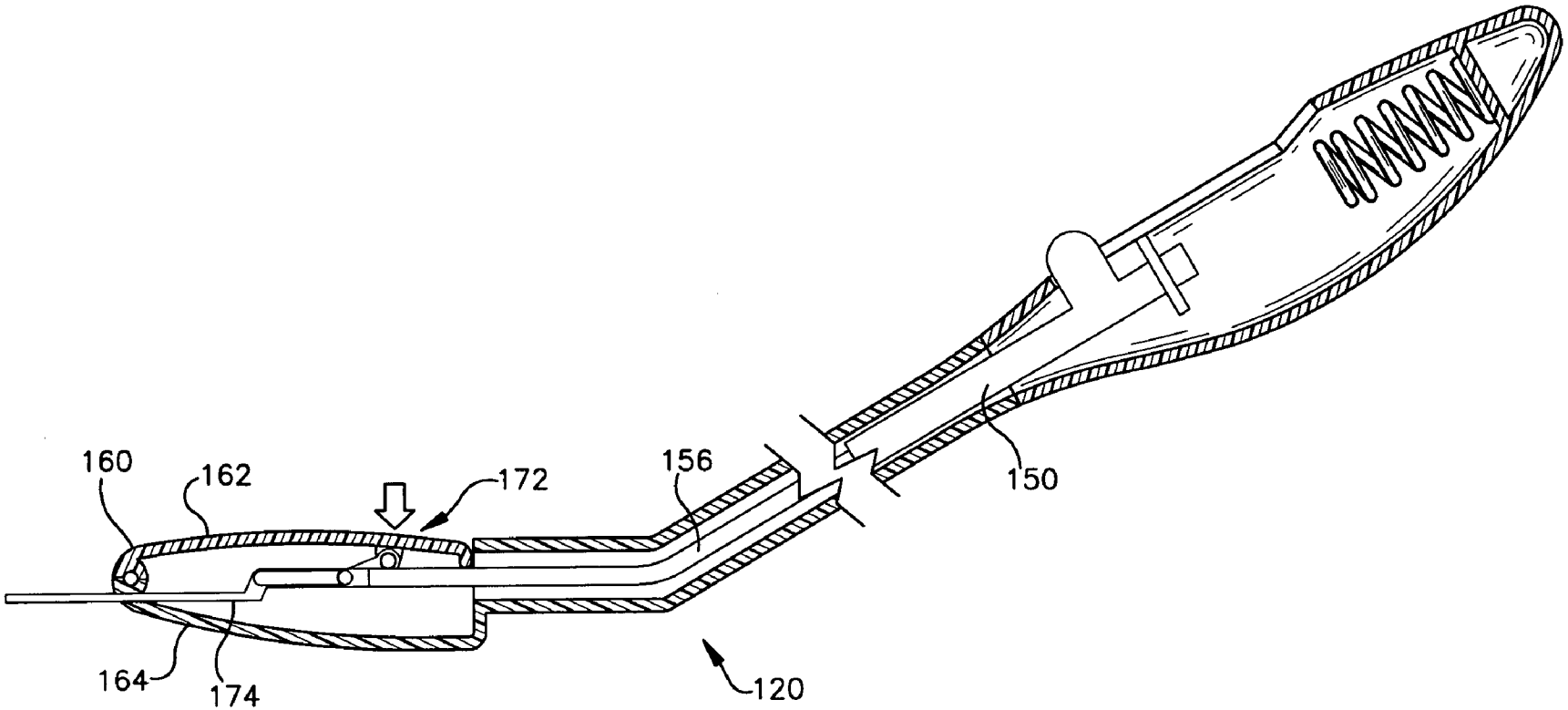
FIG. 13 is a cutaway view of the alternate embodiment of a toilet cleaning tool in a third operative position
Figure 14:
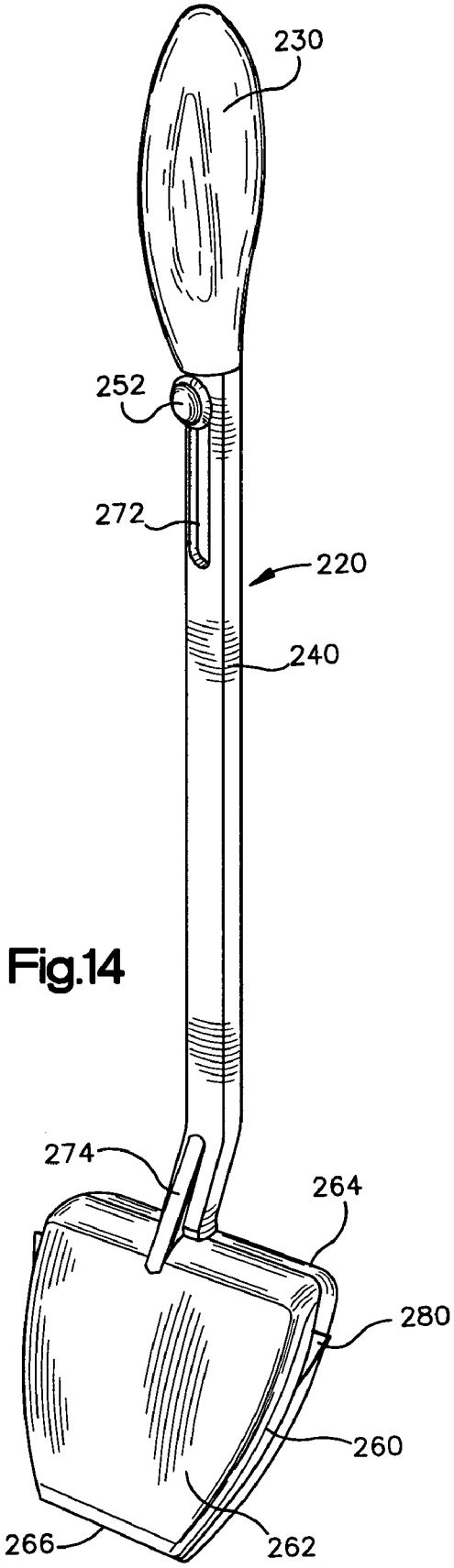
FIG. 14 is a perspective view of yet another alternate embodiment of the toilet cleaning tool.
Figure 15A:
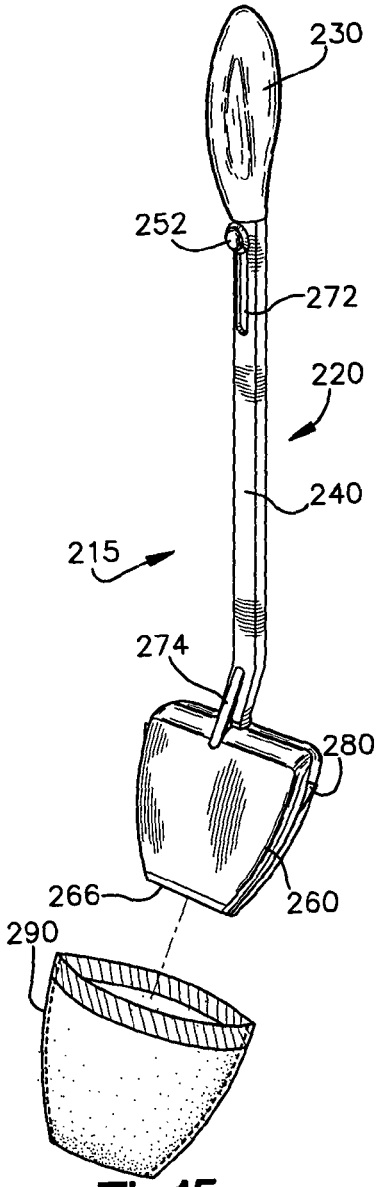
FIG. 15*a* is a perspective view of the alternate embodiment of the toilet cleaning tool and swab.
Figure 15B:
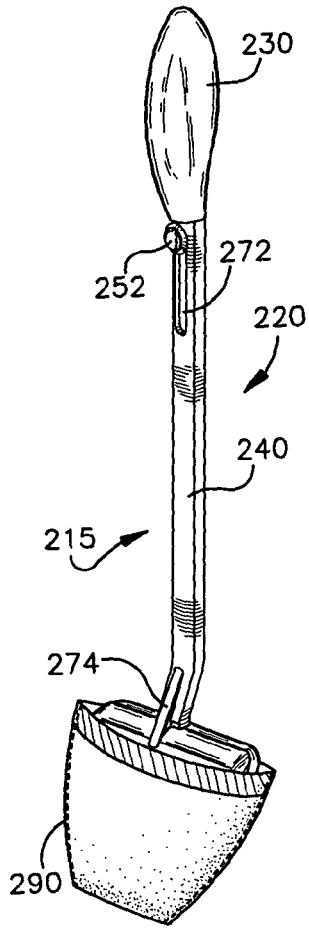
FIG. 15*b* is a perspective view of the alternate embodiment of the toilet cleaning tool with the swab fitted to the tool.
Figure 15C:
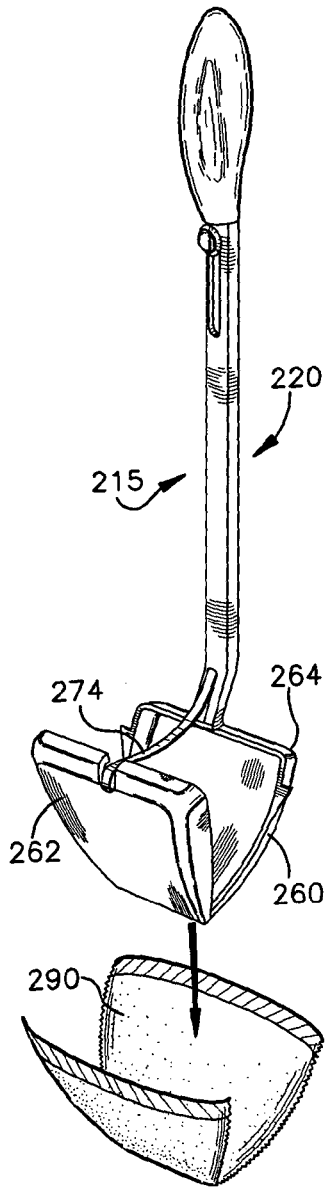
FIG. 15*c* is a perspective view of the alternate embodiment of the toilet cleaning tool and swab with the swab removed for disposal.

FIGS. 11, 12 and 13 show an alternate embodiment of the head 160 and pushrod assembly 150 of the toilet cleaning tool 120. The pushrod assembly 150 includes a linkage system 172 and pusher paddle 174. In a first or loading position shown in FIG. 11 the pushrod 156 is fully retracted causing the pusher paddle 174 to be concealed within the head 160 and the portions 162 and 164 of the head 160 to be in a compressed configuration. FIG. 12 shows a second partially extended position of the pushrod 156. In this position, the paddle pusher 172 remains concealed within the head 160, however the linkage 172 is rotated such that the portions 162 and 164 of the head 160 are expanded apart. FIG. 13 shows a third position of the pushrod assembly 150 wherein the pushrod 156 is fully extended. The paddle pusher 174 is extended outside of the head 160 which would allow the removal of a swab (not shown) from the head 160 of the tool 120. Additionally, the linkage 172 is further rotated allowing the portions 162 and 164 of the head 160 to retract back into a compressed position which allows the swab to easily slide off of the head 160.

FIGS. 14 and 15*a–c* show an alternate embodiment of the toilet cleaning apparatus comprising a tool 220 and swab 290. In this embodiment, the swab 290 is detached from the head 260 of the tool 220 by the opening of two portions 262 and 264 of the head 260. A slide control button 252 is used to extend a control arm 272 which includes an armature 274 at the end of the control arm 272 opposite the handle section 230 of the tool 220. The head 260 includes a hinge 266 at an end opposite the end attached to the middle section 240 of the tool 220. The head 160 may include a plurality of barbs 280 used to hold the swab 190 in place during use.

The swab 290 may again be formed from a single piece, bound on two sides, or two pieces, bound on three sides. The swab 290 includes perforations which allow two of the bound sides to be separated as the two portions 262 and 264 of the head 260 are fully expanded. Alternatively, the side may be attached in a manner such as gluing or sewing intermittently to allow for easy separation.

Although the invention has been shown and described with reference to certain preferred and alternate embodiments, the invention is not limited to these specific embodiments. Minor variations and insubstantial differences in the various combinations of materials and methods of application may occur to those of ordinary skill in the art while remaining within the scope of the invention as claimed and equivalents. Use of the term "or" herein is the inclusive, and not the exclusive use.

The invention claimed is:

1. A toilet cleaning tool for as with a swab having a head-receiving pocket, comprising:

a handle, and a cleaning head operatively connected to the handle, said cleaning head comprising first and second complimentary head sections that are separately slidable and pivotable with respect to one another, and each comprises corresponding edges including one front edge and two side edges, wherein said first and second head sections are movable one relative to the other between a loading position a use position, and an unloading position, and wherein in said loading position, said first and second head sections are engaged with their corresponding front and side edges substantially in contact, and wherein in said use position, one or both of said first and second head sections are at least partially vertically displaced from one another and partially or fully disengaged from one another, and wherein in said unloading position, said first and second head sections are partially disengaged and slidably displaced one relative to the other.

2. A toilet cleaning tool according to claim 1, comprising:

a cleaning swab having a head-receiving pocket that is removably attachable to the cleaning head.

3. A toilet cleaning tool according to claim 2, wherein said cleaning swab has a substantially trapezoidal shape and comprises one or more pieces, and said cleaning swab has four edges wherein three edges are closed and one edge is opened to form a pocket within the swab.

4. A toilet cleaning tool according to claim 3, wherein said cleaning swab comprises two substantially complimentary pieces, each of said pieces having four edges, wherein at least three of the four edges of each piece are aligned, and wherein the swab is formed by substantially sealing together three of the four edges of the two pieces.

5. A toilet cleaning tool according to claim 2, wherein said cleaning swab comprises a material of about seventy five percent cotton by weight and twenty five percent rayon by weight.

6. A toilet cleaning tool according to claim 2, wherein said cleaning swab comprises a binder of poly vinyl acetate.

7. A toilet cleaning tool according to claim 2, wherein said cleaning swab comprises a surfactant.

8. A toilet cleaning tool according to claim 2, wherein said cleaning swab is attachable to said cleaning head when said toilet cleaning tool is in a loading position, and wherein said cleaning swab is displaceable from said cleaning head when said cleaning tool is in an unloading position.

9. A toilet cleaning tool according to claim 2, wherein said cleaning swab is displaceable from said cleaning head without causing rupture or destruction of said cleaning pad.

10. The toilet cleaning tool according to claim 1, comprising an actuator.

11. The toilet cleaning tool according to claim 10, wherein the actuator is located in the handle and is in operable communication with one or both of said first and second head sections of said cleaning head.

12. The toilet cleaning tool according to claim 11, wherein the actuator comprises a control rod which extends from said handle to one or both of said first and second head sections of said cleaning head.

13. The toilet cleaning tool according to claim 12, wherein said control rod connects at the handle a control button and connects at the cleaning head with one or both of said first and second head sections.

14. The toilet cleaning tool according to claim 13, wherein said control button can be moved alternately between a loading position, a use position, and an unloading position.

15. The toilet cleaning tool according to claim 11, wherein the actuator comprises a cam and at least one cam follower attached to one or both of said first and second head sections of said cleaning head.

16. The toilet cleaning tool according to claim 1, wherein said first and second head sections are substantially symmetrical.

17. The toilet cleaning tool according to claim 1, wherein one or both of said first and second cad sections comprise one or more of protrusions, teeth, or surface texturing to facilitate gripping an attached cleaning swab.

18. The toilet cleaning tool according to claim 1, wherein one or both of said first and second head sections comprise one or more holes, slots or gaps to facilitate draining.

19. The toilet cleaning tool according to claim 1, comprising a caddy, said caddy comprising a holder for supporting and storing said cleaning tool, said holder contoured to support said cleaning tool and comprising one or more holes for draining, and a holder for a positioning a cleaning swab to facilitate hands-free attachment of a swab to the tool cleaning head.

20. A toilet cleaning tool for use with a swab having a head-receiving pocket, comprising:

a handle, and a cleaning head operatively connected to the handle, said cleaning head comprising first and second complimentary head sections that are separately slidable and pivotable with respect to one another, and each comprises corresponding edges including one front edge and two side edges, wherein said first and second head sections are movable one relative to the other between a loading position, a use position, and an unloading position, wherein, when said tool is in the use position, all or a portion of one or both of said first and second head sections is pivotably moved away from one another by rotation around an axis that is parallel to one of their corresponding edges.

21. The toilet cleaning tool according to claim 20, wherein, one or both of said first and second head sections is pivotably rotated around an axis that is parallel to and aligned with their cone pending front edges.

22. A toilet cleaning tool or use with a swab having head-receiving, pocket comprising:

a handle and a cleaning head operatively connected to the handle said cleaning head comprising first and second complimentary head sections that are separately slidable and pivotable with respect to one another, and each comprises corresponding edges including one front edge and two side edges, wherein said first and second head sections are movable one relative to the other between a loading position, a use position and an unloading position, and wherein, when said tool is the unloading position, said first and second head sections are slidably moved one relative to another, whereby two of the edges of each of said first and second head sections are in partial contact and one of their edges are not aligned and not in contact.

23. The toilet cleaning tool according to claim 22, wherein, the side edges of said first and second head sections are aligned and in partial contact and their front edges are not aligned and not contact.

24. A toilet cleaning tool for use wit a swab having a head-receiving pocket, the tool comprising a handle and a cleaning head operatively connected to the handle, the cleaning head comprising complementary head sections moveable with respect to one another between a loading position in which the head sections are generally aligned for insertion of the cleaning head into the head-receiving pocket of the flushable swab, and alternatively between a use position in with the head sections are at least partially separated from one another in a first direction to expand the cleaning head inside the head-receiving pocket for holding the swab on the head, and an unloading position in which the head sections move apart in a second direction different from the first direction to expand the cleaning head at least partially outside the head-receiving pocket for removing the swab from the cleaning head.

25. The toilet cleaning tool of claim 24, comprising an actuator operatively connected from the handle to the cleaning head for moving the head sections between the loading position and the use position and, alternatively, between the loading position and the unloading position.

26. The toilet cleaning tool of the claim 25, wherein the head sections pivot apart as they move between their loading and use positions.

27. The toilet cleaning tool of claim 25, wherein the head sections slide apart as they move between their loading and unloading positions.

28. A toilet cleaning tool, comprising:

a handle, and a cleaning head operatively connected to the handle, said cleaning head comprising first and second complimentary head sections that are separately slidable and pivotable with respect to one another, wherein said first and second head sections are movable one relative to the other between a loading position, a use position, and an unloading position, an actuator located in the handle and in operable communication with one or both of said first and second head section of said cleaning head, the actuator comprising a control rod at extends from said handle to one or both of said first and second head sections of said cleaning head a control button that can be moved alternately between a loading position, a use position, and an unloading position a cam and at least one cam follower attached to one or both of said first and second head sections of said cleaning head, said cam follower being generally planar and having a first and a second end, wherein said cam follower is attached at its first end directly to said cam, and wherein said cam follower is attached at its second end to said cam by a spring, and wherein said cam follower is fixedly attached to one of said cleaning head sections with the first end of said cam follower positioned closest to the handle, and the second end of said cam follower positioned opposite the handle and closest to the front edge of the cleaning bead, whereby the cam can be actuated to move said cleaning head alternately from said loading position into said use position by rearward displacement of said cam and extension of said spring, and into said unloading position by forward displacement of said cam.

* * * * *